US005850720A

United States Patent [19]

Willis

[11] Patent Number: 5,850,720

[45] Date of Patent: Dec. 22, 1998

[54] PLASTIC DECKING AND SECUREMENT SYSTEM AND METHOD OF INSTALLATION

[75] Inventor: Mark C. Willis, 4215 Hart Rd., Richfield, Ohio 44286

[73] Assignee: Mark C. Willis, Richfield, Ohio

[21] Appl. No.: 742,862

[22] Filed: Nov. 1, 1996

Related U.S. Application Data

[63] Continuation-in-part of Ser. No. 407,715, Mar. 21, 1995, Pat. No. 5,623,803.

[51] Int. Cl.[6] ..... E04H 12/02

[52] U.S. Cl. ..... 52/650.3; 52/480; 52/403.1

[58] Field of Search ..... 52/177, 650.3, 52/480, 403.1, 97

[56] References Cited

U.S. PATENT DOCUMENTS

| | | | |
|---|---|---|---|
| 2,862,255 | 12/1958 | Nelson . | |
| 3,045,294 | 7/1962 | Livezey, Jr. . | |
| 3,387,422 | 6/1968 | Wanzer . | |
| 3,389,930 | 6/1968 | Ashworth et al. . | |
| 3,405,493 | 10/1968 | Omholt | 52/480 |
| 3,617,020 | 11/1971 | Zeltverleih . | |
| 3,619,963 | 11/1971 | Omholt | 52/480 |
| 3,822,053 | 7/1974 | Daily . | |
| 3,902,703 | 9/1975 | Bouye . | |
| 3,921,960 | 11/1975 | Bright . | |
| 4,026,084 | 5/1977 | Goose . | |
| 4,108,422 | 8/1978 | Fleischmann . | |
| 4,138,094 | 2/1979 | Thir . | |
| 4,140,298 | 2/1979 | Coleman, Jr. . | |
| 4,477,058 | 10/1984 | Lowery . | |
| 4,572,694 | 2/1986 | Hoeksema . | |
| 4,609,185 | 9/1986 | Prater et al. . | |
| 4,691,484 | 9/1987 | Wilson . | |
| 4,783,040 | 11/1988 | Lindberg et al. . | |
| 4,809,955 | 3/1989 | Veilleux . | |
| 4,823,529 | 4/1989 | Canfield et al. . | |
| 4,833,842 | 5/1989 | Anastasio . | |
| 5,230,186 | 7/1993 | Hammonds et al. . | |
| 5,274,977 | 1/1994 | Bayly . | |
| 5,275,381 | 1/1994 | Cluff et al. . | |
| 5,361,554 | 11/1994 | Bryan | 52/480 |
| 5,394,667 | 3/1995 | Nystrom . | |
| 5,660,016 | 8/1997 | Erwin et al. | 52/480 X |

FOREIGN PATENT DOCUMENTS

| | | |
|---|---|---|
| 1212178 | 9/1958 | France . |

OTHER PUBLICATIONS

Brochure entitled "The Carpenter's Steel Stud" Nail it!.

*Primary Examiner*—Christopher Kent
*Assistant Examiner*—Yvonne Horton-RIchardson
*Attorney, Agent, or Firm*—Emerson & Associates; Roger D. Emerson

[57] ABSTRACT

A structure for decks or other structures is disclosed which utilizes recycled plastic lumber decking planks which slide onto a rigid frame. The frame includes supporting members having protruding "T"-shaped connectors which selectively fit into preformed grooves on the side surfaces of the plastic planks. The manner in which the planks are secured to the frame allows for the expansion and contraction of the individual plank lengths due to temperature variations. In addition, brackets are provided which fasten railings and the like to the rigid frame.

5 Claims, 5 Drawing Sheets

PLASTIC DECKING AND SECUREMENT SYSTEM AND METHOD OF INSTALLATION

CROSS-REFERENCE TO RELATED APPLICATIONS

This application is a continuation-in-part of pending U.S. patent application, Ser. No. 08/407,715, filed Mar. 21, 1995, now U.S. Pat. No. 5,623,803.

BACKGROUND OF THE INVENTION

1. Field of Invention

This invention pertains generally to the art of deck construction for residential and commercial buildings and more specifically to a securement system for a deck constructed from plastic lumber.

2. Description of the Related Art

Conventional decks around homes, pools, docks and the like are often constructed from pressure-treated wooden decking on top of a treated lumber frame, made of joists, the joists being attached to posts set three to four feet into the ground into a concrete base. The entire structure is used to maintain the structural integrity. The joists hold the decking.

Constructing a deck from wooden material has some disadvantages. The wood needs to be repeatedly and systematically treated or painted to protect it from the elements. Also, regular maintenance such as stripping and refinishing must be performed in order to keep up the appearance of the deck. Unfortunately, the wood material may still warp, crack, splinter or rot.

Plastic as a building material, and specifically a building material for decks, has the advantages of being able to be colored with coloring agents, being able to be extruded to various configurations, being recyclable, being environmentally friendly, being able to be constructed of recycled materials, not splintering, rotting, or cracking as well as others.

However, plastic has the significant disadvantage of dimensional instability due to daily temperature changes. Due to temperature variations in the ambient air, decking made of plastic tends to expand along its extruded length as it warmed and contract as it cools. This dimensional variation is too great for a deck of plastic wood to be constructed in the conventional way.

Efforts by others to address the challenges raised by using plastic as a building material include U.S. Pat. No. 4,477,058 to Lowery which discloses a fence made of plastic components. The fence can be constructed of plastic fence boards which have holes formed in one side for receiving pegs. Some of the holes are vertical slots to allow the fence boards to be placed at various heights to accommodate uneven terrain. Lowery does not address in any way the problems raised by the thermal dimensional instability of plastic.

U.S. Pat. No. 4,026,084 to Goose discloses a construction system which uses extruded sections, one of which has a channel formed therein. However, Goose appears to be directed to constructions systems for interior office spaces utilizing aluminum connecting components.

U.S. Pat. No. 4,108,422 to Fleischmann discloses an arrangement for supporting railing which includes a T-shaped groove.

However, none of the known prior art discloses a solution to the problem of the thermal dimensional instability of plastic.

The present invention contemplates a new deck construction and securement system which is simple in design, effective in use, and overcomes the foregoing difficulties and others while providing better and more advantageous results.

SUMMARY OF THE INVENTION

In accordance with the present invention, a new and improved deck construction and securement system is provided.

More particularly, in accordance with the invention, the deck construction comprises a rigid frame, which does not rely on the decking material to keep it true and a plastic lumber decking which is slidably secured to a rigid frame.

According to one aspect of the invention, a deck structure comprises a rigid frame of spaced-apart, supporting members; a plurality of planks closely received transversely to the supporting members, each of the planks having a longitudinal groove therein; and, a plurality of connectors protruding from the frame and selectively fitting into the grooves for slidably connecting the planks to the frame.

According to another aspect of the invention, the deck structure comprises means for rigidly securing one end of each plank to the frame.

According to another aspect of the invention, the planks are constructed of man-made materials such as plastic.

According to another aspect of the invention, the planks comprise inwardly extending flange voids on either side of the grooves contained therein.

According to another aspect of the invention, each connector comprises a head, the head being inward of the flange voids to prevent displacement of the plank away from the frame.

According to another aspect of the invention, each connector is "T-shaped", with the cross bar of the connector aligned parallel to the direction of the supporting members.

According to another aspect of the invention, the supporting members are placed approximately 12 inches apart.

According to another aspect of the invention, the supporting members are constructed of corrosion resistant material such as metal or fiberglass.

According to another aspect of the invention, the deck structure comprises brackets which are fixed to the frame at spaced-apart intervals to allow the attachment of a railing.

According to another aspect of the invention, lumber for use in a decking system comprises plastic material with a longitudinal groove therein and inwardly extending flange voids on either side of the groove.

According to another aspect of the invention, a connector for use in a decking system and protruding from a supporting frame comprises a head portion for slidably attaching plastic lumber without permitting displacement of the plank from the frame.

One advantage of the present invention is the time saved during installation. Because the decking planks can be extruded to their finished lengths, joints, and the accompanying measuring and cutting, can be eliminated. Also, the method of installation allows each plank to be quickly installed by sliding it into place on the frame.

Another advantage of the present invention is its convenience. The plastic decking can be colored with coloring agents during its extrusion. The coloring agents can be chosen to match the color of the associated structure, for example a house. The decking therefore does not need to be pre-treated or painted, nor does it require stripping and refinishing to maintain is appearance.

Another advantage of the present invention is its durability. The plastic decking will not warp, crack, splinter or rot over time.

Another advantage of the present invention is its use of recycled plastic which is an environmentally friendly construction material.

Still other benefits and advantages of the invention will become apparent to those skilled in the art upon a reading and understanding of the following specification.

BRIEF DESCRIPTION OF THE DRAWINGS

The invention may take physical form in certain parts and arrangement of parts. A preferred embodiment of these parts will be discussed in detail in the specification and illustrated in the accompanying drawings, which form a part of this disclosure and wherein.

DESCRIPTION OF THE PREFERRED EMBODIMENT

Figure 9:
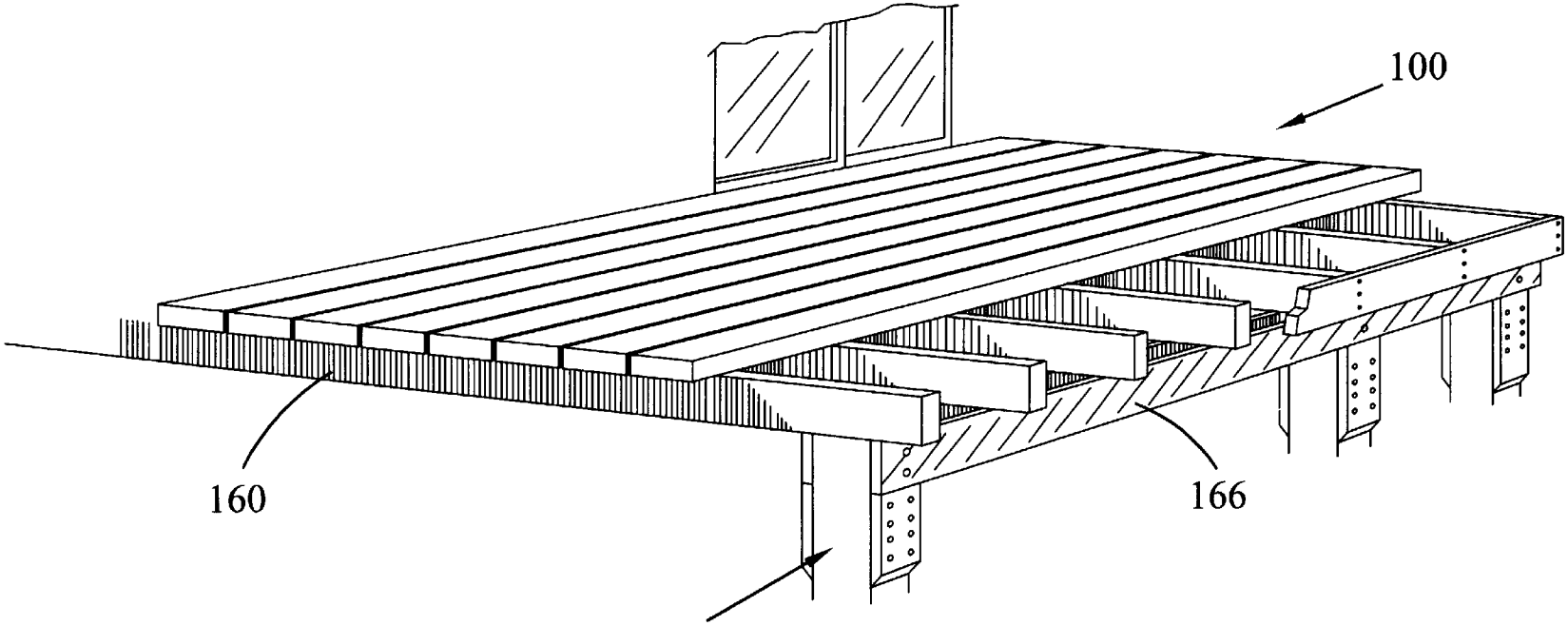
FIG. 9 is a perspective view of a typical prior art wood deck.

Referring now to the drawings, which are for purposes of illustrating a preferred embodiment of the invention only, and not for purposes of limiting the invention, FIG. 9 illustrates a prior art wooden deck 100, such as might be attached to a residential home or commercial establishment. The deck 100 is comprised of joists 160, posts 162, and beams 166. The invention is similar to a prior art wooden deck, but uses components made of plastic lumber instead of wooden components.

Figure 1:
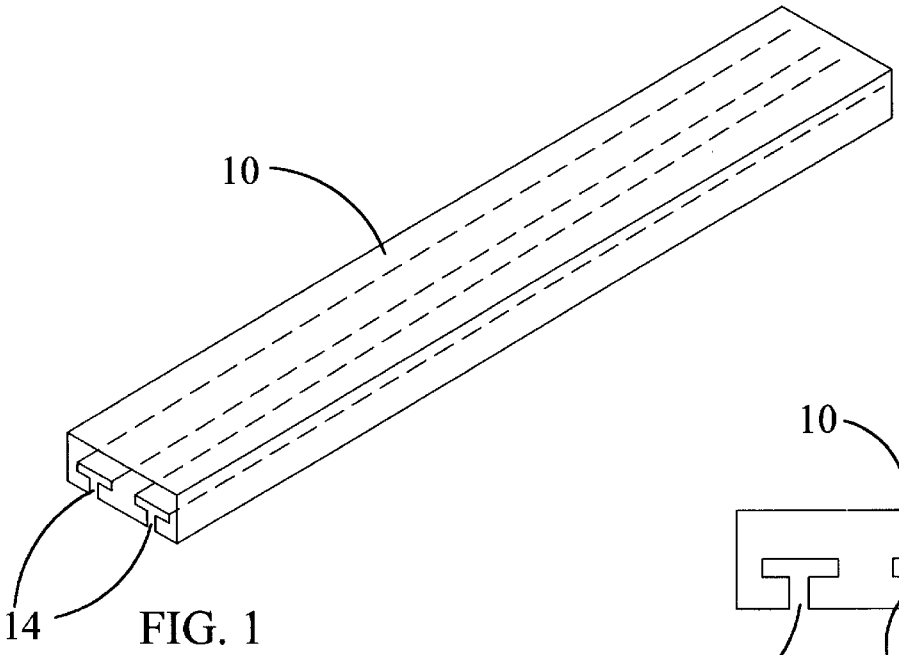
FIG. 1 is a perspective view of a plastic lumber plank according to the invention.

For example, with reference to FIG. 1, a plastic lumber plank 10 according to the invention can be extruded to such a length as to eliminate the need for joints in the deck construction. This represents one advantage over wood decking, since wood planks must be butt-spliced, creating a joint. It may also extruded with a textured non-slip surface or one that has a decorative pattern such as geometric shapes or wood grain.

One or more longitudinal grooves 14 are formed in the underside 12 of the plank 10. The longitudinal grooves 14 in the plank 10 further includes inwardly extending flange voids 18 on either side of the groove 14. In a preferred embodiment, each plank 10 would be ¾inches thick and 5½inches wide and contain two longitudinal grooves 14 therein.

Figure 2:
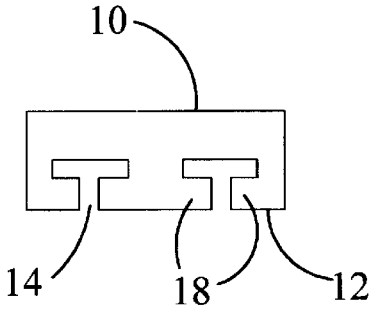
FIG. 2 is an end view of the plank of FIG. 1.

With reference to FIG. 2, a preferred embodiment of the plank 10 comprises two parallel longitudinal grooves 14. The inwardly extending flange voids 18 give the longitudinal grooves 14 "T"-shaped cross-sectional configuration.

Figure 3:
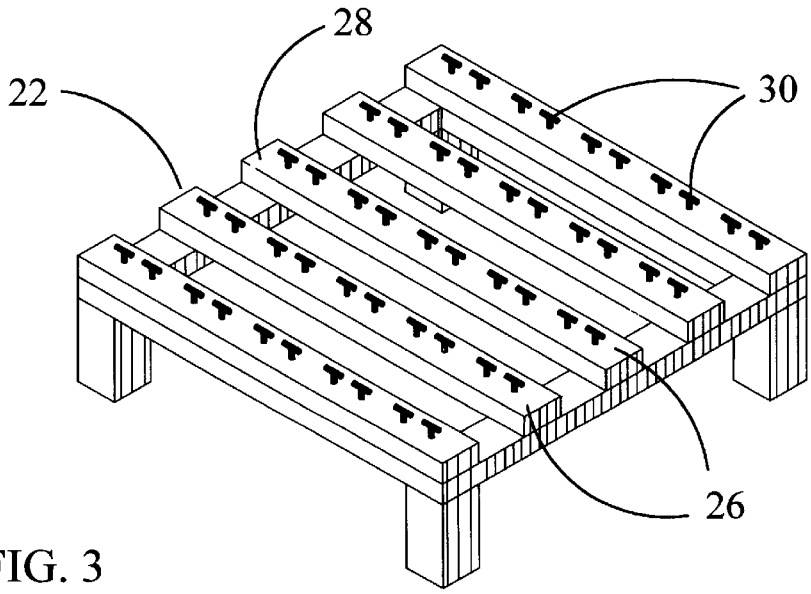
FIG. 3 is a perspective view of a rigid frame according to the invention.

With reference to FIG. 3, a perspective view of the rigid frame 22 according to the invention is illustrated. As in conventional deck construction, the frame 22 rests on posts which are secured into the ground. The frame 22 comprises rigidly secured, spaced-apart supporting member 26. The frame 22 forms an independent rigid structure. The frame 22 may comprise wooden joists which are rigidly held by cross bracing (not shown). In the preferred embodiment, the frame 22 comprises weather-resistant, corrosion-resistant metal such as aluminum, galvanized steel, stainless steel and the like which is rigidly joined together. In this way, a frame 22 is constructed which does not rely upon the decking material to achieve structural rigidity. In a preferred embodiment, the supporting members are spaced approximately 12 inches apart, rather than the 16 inches to 24 inches as in conventional deck construction, to give proper support to the plastic planks 10.

Figure 4:
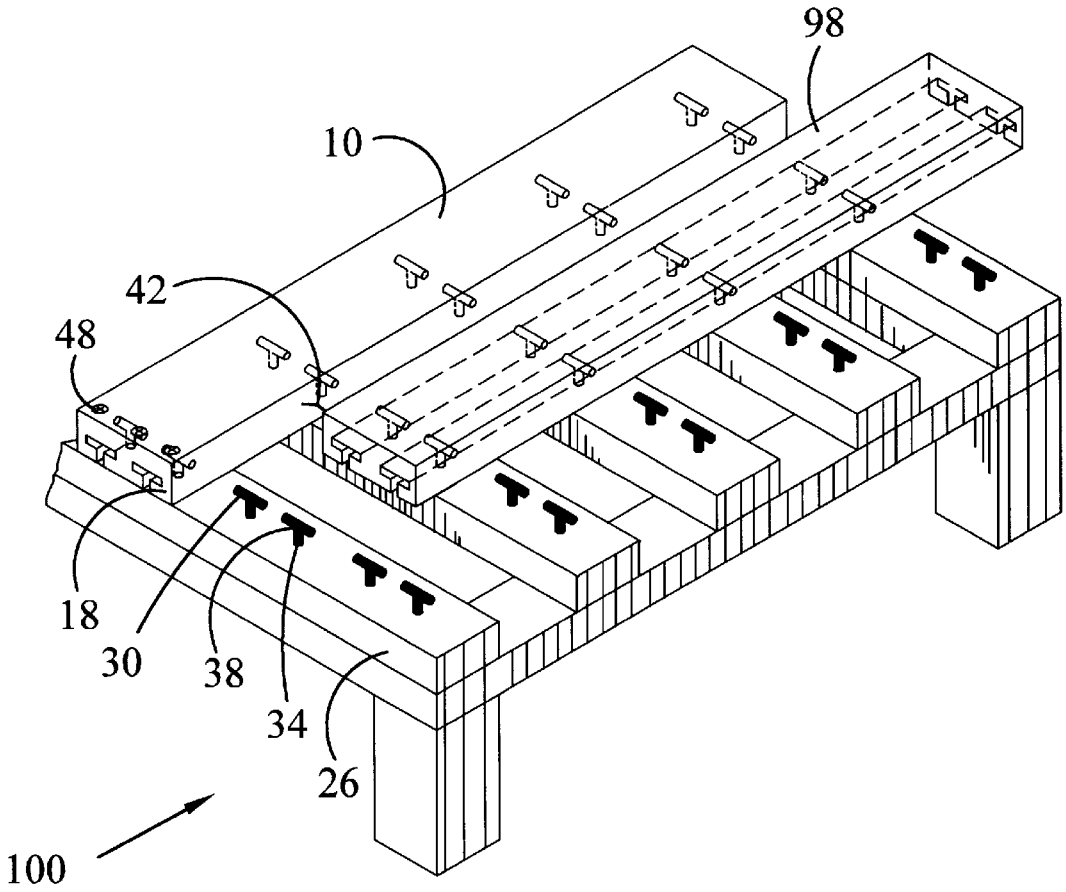
FIG. 4 is a perspective view of a supporting member with attached connectors and associated planks.

With reference to FIGS. 3 and 4, protruding from an upper surface 28 of the supporting members 26 are connectors 30. The connectors 30 serve to slidably secure the planks 10 to the frame 22. The connectors 30 are preferably made of a weather-resistant, corrosion-resistant metal.

As shown in FIG. 4 each connector 30 has a base portion 34 and a head portion 38. The connectors 30 have a cross-sectional configuration essentially the same as the longitudinal grooves 14 along with the flange voids 18, although the connectors 30 are slightly smaller to facilitate the sliding of the planks 10 over the connectors 30. The head portion 38 of the connector 30 is located inward of the extending flange voids 18 of the plank 10 to allow the plank 10 to be slidably secured to the support member 26 without allowing displacement of the plank 10 away from the supporting member 26. In a preferred embodiment, the connectors 30 are "T"-shaped. The base 34 of the connector 30 is fixed to the supporting members 26. The head portion 38 is arranged parallel with the supporting members 26.

The configuration of the connectors 30 and the planks 10 enable a deck 100 according to the invention to have all of the benefits of a plastic decking material without the drawbacks which previously made plastic unsuitable for this application. Plastic as a building material, and specifically a building material for decks, has the advantages of not rotting, splintering or corroding due to weather, being able to be colored with coloring agents, being able to be extruded to various configurations, being recyclable, being environmentally friendly, being able to be constructed of recycled materials, as well as others.

However, plastic also has the significant disadvantage of dimensional instability due to temperature changes. Previous to the herein disclosed invention, due to daily temperature variations in the ambient air as the seasons changed, decking made of plastic and rigidly fastened together would deflect too greatly for a deck to be properly constructed.

With continuing reference to FIG. 4, in the inventive deck 100, the decking planks 10 are placed transversely to the supporting members 26. As can been seen in FIG. 4, the planks 10 slide over the protruding connectors 30 in the direction indicated by the arrow 98. The connectors 30 on each supporting member 26 are spaced to allow a small gap 42 to be formed between adjacent planks 10.

The slidable manner in which the planks 10 are connected to the frame 22 accommodates and allows for the dimensional instability of the plastic planks 10. For instance, over an approximate 12 foot length, the plank 10 may expand or contract 2 inches in length during the course of a day due to temperature variations. Rigidly attaching the plank 10 to the frame 22, such as through prior art nailing techniques would generate tensile forces as the planks 10 tried to respond to the rising temperature by stretching. Being unable to simple lengthen, and being constrained by natural laws to grow, the planks 10, would buckle and the frame, would warp.

According to the invention, a rigid frame 22 is built and the planks 10 are secured in such a way as to allow the unhindered expansion and contraction of the planks 10 along their lengths. In a preferred embodiment, one end of the plank 10 is rigidly secured to a supporting member 26 with securing means 48. While any securing means 48 can be used which is chosen with good engineering judgment, the preferred securing means 48 is a screw. Securing only one end of the plank 10 provides sufficient securement while allowing expansion or contraction along the length of the plank 10. The securing means 48 is used at the end of the plank 10 where movement is least desirable, with any displacement therefore occurring at only the opposite end of the plank 10.

Figure 5:
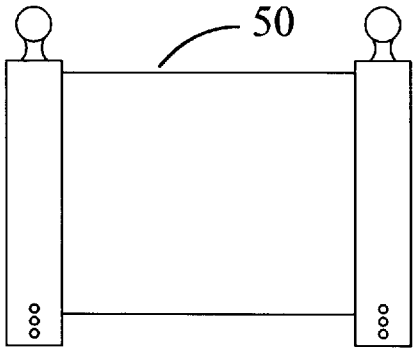
FIG. 5 is a first rail embodiment according to one embodiment of the invention.
Figure 6:
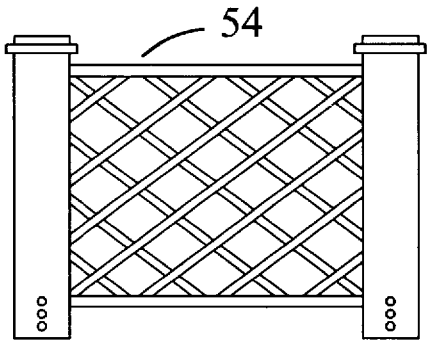
FIG. 6 is a second rail embodiment according to one embodiment of the invention.

The process and elements described above can be further configured into related articles. For example, with reference to FIGS. 5 and 6, two embodiments 50 and 54 of railing type structures that may be used to complete the deck structure are illustrated.

Figure 7:
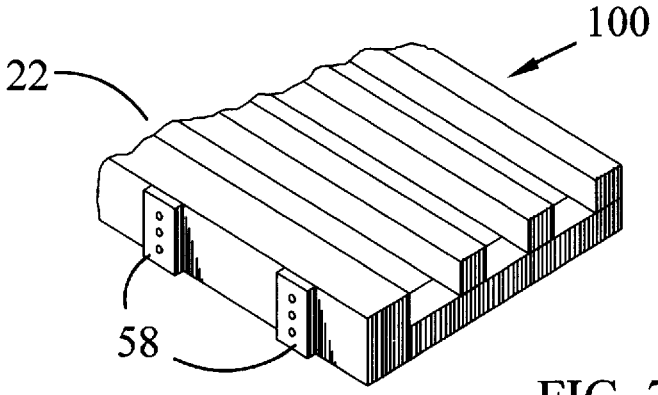
FIG. 7 is a partial view of the frame of FIG. 3 with rail brackets.

FIG. 7 shows brackets 58 used in the preferred embodiment to secure railing structures 50, 54 or the like to the rigid frame 22.

Figure 8:
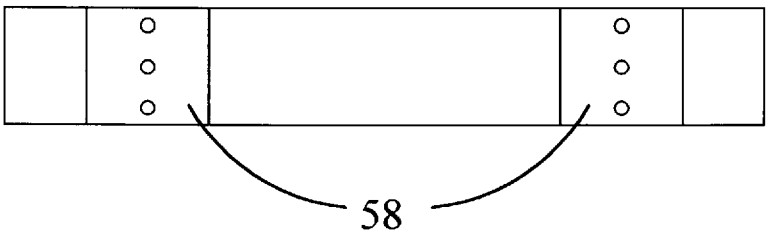
FIG. 8 is an end view of the brackets of FIG. 5.

An end view of the brackets 58 is shown in FIG. 8.

Figure 10:
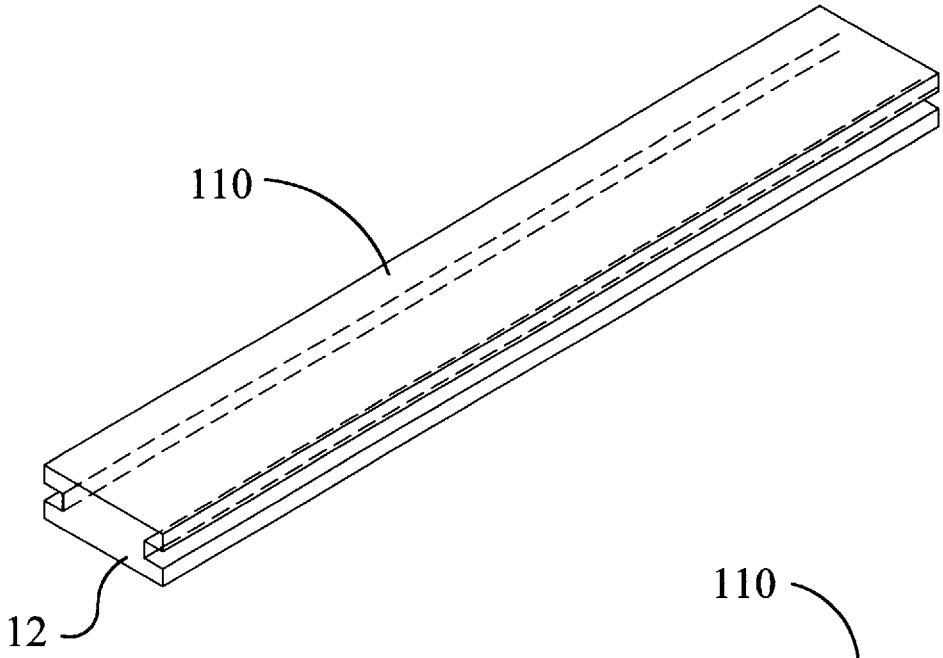
FIG. 10 is a perspective view of a plastic lumber plank according to another embodiment of the invention.
Figure 11:
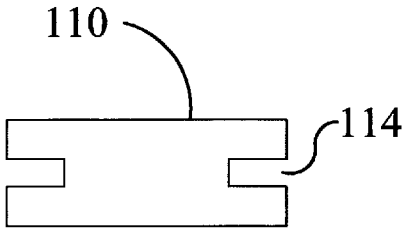
FIG. 11 is an end view of the plank of FIG. 10.
Figure 12:
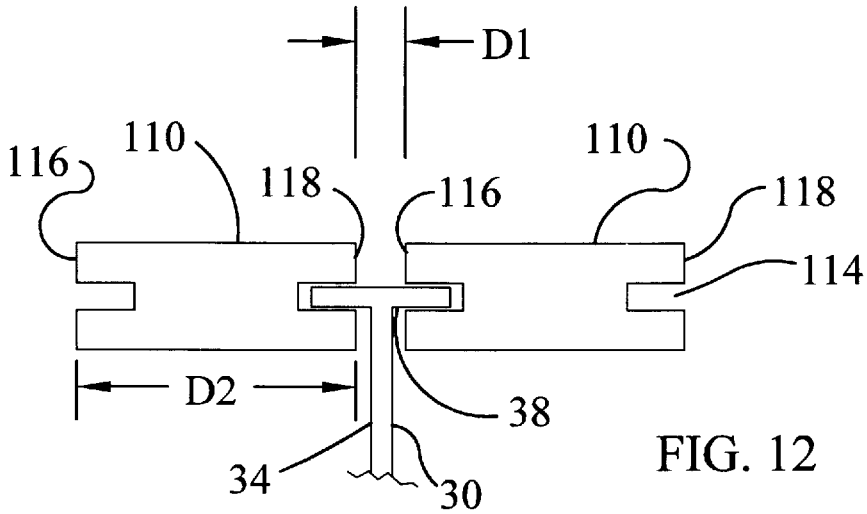
FIG. 12 is a schematic end view of the plank of FIGS. 10 and 11 shown as assembled with a connector 30.

With reference to FIGS. 10–12 another embodiment of the invention will be illustrated. In this embodiment, the grooves 114 are in the side surfaces 116,118 of the planks 110. The same connectors 30 are used, but rather than fitting into a "T-shaped" groove 14 in the underside 12 of the plank 10 as illustrated in FIG. 2, in this embodiment the connectors 30 fit into the planks 110 as illustrated in FIG. 12.

An important element of the alternate embodiment illustrated in FIGS. 10–12 is the dimension D1 illustrated in FIG. 12. The distance D1 is the laterally spaced distance between adjacent side surfaces of planks 10. It is important that the distance D1 be large enough to effectively drain the deck surface, but not be so great as to catch someone's toe and trip them. In the preferred embodiment of the invention, D1 is between 0.1 inches and 1.0 inches, and preferably D1 is equal to 0.25 inches. Another way to measure D1 is by relating it to the widths of the planks 110. Under this scheme, D1 is preferably between 1% and 25% of the width D2 of a plank 110. It is important that D1 be greater than zero to effectively drain the deck surface. This is a departure from prior art where the side surfaces 116,118 of adjoining planks 110 are pressed against each other.

While the invention has been disclosed with reference to an outdoor deck, the invention is also applicable to other structures, especially those near water. For example, the invention would be excellent for flooring near a pool or a boardwalk near a pool, lake, or other source of moisture.

The present invention has been described with reference to the preferred embodiment. Obviously, modifications and alterations will occur to others upon a reading and understanding of the specification. It is intended by the applicant to include all such modifications and alterations insofar as they come within the scope of the appended claims or the equivalents thereof.

Having thus described the invention, it is now claimed:

1. A structure comprising:

a frame, said frame comprising spaced-apart, supporting members;

a plurality of planks, said planks comprising plastic material and being received transversely to said supporting members, each of said planks having a first and second side surface, a first longitudinal groove being in said first side surface; and, a plurality of connectors, said connectors protruding from said frame and being fixedly attached thereto so that said planks are slidable relative to said frame in a direction parallel a longitudinal centerline of said grooves.

2. A method for building a structure of plastic lumber planks, each plank having first and second longitudinal grooves in side surfaces of said planks, said method comprising the steps of:

building a framework comprising spaced-apart, parallel supporting members;

fixedly attaching a plurality of spaced-apart connectors to said supporting members;

mounting said plastic lumber planks transversely to said supporting members by sliding said plastic lumber planks over said connectors so that said connectors are received into said first and second grooves; and, providing means to accommodate movement of said plastic lumber planks in a direction parallel a longitudinal centerline of said grooves after said step of mounting said plastic lumber planks.

3. The structure of claim 1 wherein said planks have adjacent side surfaces laterally spaced a distance D1 that is between 0.1 inches and 1.0 inches.

4. The structure of claim 1 wherein said planks have a width D2 and have adjacent side surfaces laterally spaced a distance D1 that is between 1% and 25% of said width D2.

5. The method of claim 2 wherein said step of mounting said plastic lumber planks further includes laterally spacing adjacent side surfaces of said plastic lumber planks a distance D1 apart wherein D1 is between 0.1 inches and 1.0 inches.

* * * * *